US009616673B2

(12) United States Patent
Domae

(10) Patent No.: US 9,616,673 B2
(45) Date of Patent: Apr. 11, 2017

(54) LIQUID JET UNIT AND LIQUID JET APPARATUS

(71) Applicant: SII PRINTEK INC., Chiba (JP)

(72) Inventor: Yoshinori Domae, Chiba (JP)

(73) Assignee: SII Printek Inc. (JP)

( * ) Notice: Subject to any disclaimer, the term of this patent is extended or adjusted under 35 U.S.C. 154(b) by 75 days.

(21) Appl. No.: 14/062,003

(22) Filed: Oct. 24, 2013

(65) Prior Publication Data

US 2014/0118448 A1 May 1, 2014

(30) Foreign Application Priority Data

Oct. 30, 2012 (JP) ..... 2012-239491

(51) Int. Cl.
*B41J 2/18* (2006.01)

(52) U.S. Cl.
CPC ..... *B41J 2/18* (2013.01)

(58) Field of Classification Search
CPC ..... B41J 2/18
See application file for complete search history.

(56) References Cited

U.S. PATENT DOCUMENTS 6,428,156 B1 8/2002 Waller et al. ..... 347/89
7,673,965 B2 * 3/2010 Mills ..... B41J 2/155 347/13
8,100,500 B2 * 1/2012 Bansyo ..... 347/19
2006/0132554 A1 6/2006 Ota et al. ..... 347/85
2008/0273046 A1 11/2008 Ishinaga et al. ..... 347/6
2008/0273064 A1 11/2008 Ota et al. ..... 347/85
2009/0002467 A1 * 1/2009 Watanabe ..... B41J 2/16526 347/89
2009/0284563 A1 * 11/2009 Bansyo ..... B41J 2/16532 347/19
2010/0073437 A1 3/2010 Shibata et al. ..... 347/85
2010/0141722 A1 * 6/2010 Saito et al. ..... 347/92
2011/0050766 A1 * 3/2011 Matsumoto et al. ..... 347/7
2011/0050794 A1 * 3/2011 Koike ..... B41J 2/125 347/22

(Continued)

FOREIGN PATENT DOCUMENTS

JP 3161345 7/1991
JP 05330073 12/1993

(Continued)

*Primary Examiner* — Matthew Luu
*Assistant Examiner* — Tracey McMillion
(74) *Attorney, Agent, or Firm* — Adams & Wilks

(57) ABSTRACT

A liquid jet unit includes a circulation path through which liquid is circulated, and a liquid jet head having an inflow port and an outflow port between which is disposed a flow path forming a part of the circulation path, and a nozzle communicating with the flow path and configured to eject liquid from the liquid jet head. A liquid pump is inserted into the circulation path for circulating liquid in the circulation path. A supply path is connected to the circulation path for supplying liquid to the circulation path. A pressure sensor detects the pressure of liquid in the circulation path and generates corresponding pressure information. The liquid pump is configured to change an amount of liquid to be fed on the basis of the pressure information generated to maintain liquid in the nozzle at a predetermined pressure and draw liquid into the circulation path from the supply path.

25 Claims, 8 Drawing Sheets

(56) References Cited

U.S. PATENT DOCUMENTS

| | | | | |
|---|---|---|---|---|
| 2011/0205315 | A1* | 8/2011 | Saga | B41J 2/17513 347/85 |
| 2012/0050357 | A1 | 3/2012 | Rasmussen | 347/6 |

FOREIGN PATENT DOCUMENTS

| | | |
|---|---|---|
| JP | 06183024 | 7/1994 |
| JP | 09104120 | 4/1997 |
| JP | 2003182103 | 7/2003 |
| JP | 2006159811 | 6/2006 |
| JP | 2012096524 | 5/2012 |
| WO | 97 30850 | 8/1997 |

* cited by examiner

LIQUID JET UNIT AND LIQUID JET APPARATUS

BACKGROUND OF THE INVENTION

Technical Field

The present invention relates to a liquid jet unit that ejects liquid droplets onto a recording medium to perform recording, and particularly to a circulation type liquid jet unit and a liquid jet apparatus using the same.

Background Information

Recently, there has been used a liquid jet head using an ink jet system that ejects ink droplets onto a recording paper or the like to record characters or figures thereon, or ejects a liquid material onto the surface of an element substrate to form a functional thin film thereon. In the ink jet system, ink or a liquid material is guided from a liquid tank into a channel of a liquid jet head through a supply path, and pressure is applied to liquid filled in the channel to thereby eject the liquid from a nozzle that communicates with the channel. When ejecting liquid, characters or figures are recorded, or a functional thin film having a predetermined shape is formed by moving the liquid jet head or a recording medium.

As liquid jet apparatuses of this type, a liquid jet apparatus that circulates liquid to be supplied to a liquid jet head is widely used. By circulating liquid, it is possible to prevent the occurrence of ejection failure caused by dust or air bubbles accumulated in the liquid jet head, and also possible to constantly supply fresh liquid to the liquid jet head. As a result, deterioration of the recording quality caused by the increase in liquid viscosity can be prevented.

JP 5-330073 A describes a circulation system in which ink is circulated between a recording head unit and an ink tank. An outward ink tube and a return ink tube are placed between the ink tank and the recording head unit. A pump is placed in the outward ink tube at the side near the ink tank. The pump pressure-feeds ink inside the ink tank to the recording head unit, and circulates ink between the ink tank and the recording head unit. With this configuration, air bubbles and ink having increased viscosity (hereinbelow, simply referred to as "viscosity-increased ink") remaining inside the tube and the recording head unit are collected into the ink tank to be removed.

JP 6-183024 A describes an ink jet recording apparatus in which an ink circulation path is constructed. The ink circulation path is connected from a recovery pump as an ink pressure-feeding unit to an ink inflow port of a recording head via a first circulation tube. Further, the ink circulation path is connected from an ink outflow port of the recording head to the recovery pump via a second circulation tube and an ink supply tank. In addition, a main tank for replenishing the ink supply tank with ink is connected to the ink circulation path. The main tank and the first circulation tube of the ink circulation path are connected to each other via a replenishing tube on which a rectification valve for replenishing is disposed.

Ink is circulated in the following manner. Ink supplied from the ink supply tank is pressure-fed to the first circulation tube by the recovery pump, and flows into a common liquid chamber of the recording head. Then, a part of the pressure-fed ink is ejected along with the operation of the recording head, and the rest part thereof is returned to the ink supply tank via the second circulation tube. Since the rectification valve for replenishing is interposed between the main tank and the first circulation tube, ink does not flow into the main tank from the first circulation tube. When ink stored in the ink supply tank has been consumed, the feeding direction of ink by the recovery pump is reversed. Accordingly, ink is sucked into the first circulation tube from the main tank, and the ink supply tank is replenished with the ink via the recovery pump.

FIG. 12 is a diagram of an ink flow path of an ink jet recording apparatus described in JP 9-104120 A. JP 9-104120 A describes the operation and configuration for reducing the increased viscosity of ink at an ejection port 120 of the ink jet head 111. In the ink flow path, a circulation path is formed by an ink circulation pump 113, a tube 117*b*, a joint 117*c*, a tube 117*a*, a common liquid chamber 112 of the ink jet head 111, and a collection tube 116. Further, ink supplied from a main ink tank 115 is pressure-fed to the joint 117*c* via the tube 119 by an ink supply pump 114 so as to be supplied to the circulation path.

When the viscosity of ink at the ejection port 120 increases, the ink circulation pump 113 is operated to collect the viscosity-increased ink through the collection tube 116. At the same time, the ink supply pump 114 is operated to supply ink to the circulation path, and ink is discharged from the ejection port 120. In this manner, the recovery operation is reliably performed with the small amount of discharged ink.

FIG. 13 is a schematic view of a liquid jet head using an ink jet system described in JP 2003-182103 A. In this liquid jet head, ultraviolet-curable ink is used. A head portion 101 is heated up to a predetermined temperature by a heating unit 104. Accordingly, ink inside the head portion 101 is heated and the viscosity thereof is thereby reduced, and the viscosity-reduced ink is ejected from the head portion 101. The ink discharged from the head portion 101 flows through a second flow path 106, and then, by the pump 107, flows through a cooling unit 110, a connection portion 109, a first flow path 103, and into the upstream side of the heating unit 104. By operating the pump 107 with a valve 108 closed, ink is circulated inside the head portion 101. By opening the valve 108 when the operation of the pump 107 is stopped, ink is supplied from an ink tank 102 to the head portion 101 via the first flow path 103 due to water head difference.

In the ink circulation system described in JP 5-330073 A, ink is fed from the pump, which is placed near the ink tank, to the recording head unit via the outward ink tube, and returned from the recording head unit and then collected into the ink tank via the return ink tube. Therefore, it is necessary to connect both of the outward ink tube and the return ink tube to the ink tank. As a result, it takes time for assembly. Further, the outward ink tube and the return ink tube are made long. Furthermore, in the operation of the recording head unit, when the ink tubes are long, pressure fluctuation associated with the inertia of ink is likely to occur. As a result, it becomes difficult to control pressure at the ejection port.

In the ink circulation path described in JP 6-183024 A, when replenishing the ink supply tank, which is placed in the ink circulation path, with ink, it is necessary to first stop the circulation of ink, and then feed ink in the direction opposite to the circulation direction thereof by the recovery pump to thereby replenish the ink supply tank with ink from the main tank. In other words, it is not possible to replenish ink through the circulation path while performing an ejection operation from the recording head.

In the ink jet recording apparatus described in JP 9-104120 A, since the ink supply pump 114 is required in addition to the ink circulation pump 113, the number of pumps increases. Further, in the liquid jet head using an ink jet system described in JP 2003-182103 A, since ink is supplied on the basis of the difference in potential head between the head portion 101 and the surface of ink inside the ink tank 102, the ink tank 102 cannot be placed on an arbitrary position. Therefore, the locations of the head portion 101 and the ink tank 102 are limited, which causes inconvenience.

SUMMARY OF THE INVENTION

The present invention has been made in view of the above problems, and is directed to providing a liquid jet apparatus having a simple connection structure between a liquid jet head and a liquid tank.

A liquid jet unit of a first aspect of the present invention includes a circulation path through which liquid is circulated; a liquid jet head that includes an inflow port and an outflow port, a flow path between the inflow port and the outflow port, the flow path constituting a part of the circulation path, and a nozzle communicating with the flow path, and ejects liquid from the nozzle; a liquid pump that is inserted into the circulation path, and circulates liquid in the circulation path; a supply path that is connected to the circulation path, and supplies liquid to the circulation path; and a pressure sensor that detects the pressure of liquid in the circulation path and generates pressure information. The liquid pump changes the amount of liquid to be fed on the basis of the pressure information to maintain liquid in the nozzle at a predetermined pressure and draw liquid into the circulation path from the supply path.

The supply path is connected to the circulation path at a position between the outflow port and the liquid pump.

The flow path resistance in the circulation path at a part between the vicinity of the outflow port and a connection point to which the supply path is connected is larger than the flow path resistance in the circulation path at a part between the liquid pump and the inflow port.

The liquid jet unit further includes a flow restricting unit that causes pressure loss in liquid being circulated. The flow restricting unit is placed in the flow path between the inflow port and the outflow port.

The liquid jet unit further includes a flow restricting unit that causes pressure loss in liquid being circulated. The flow restricting unit is placed in the circulation path at a position between the liquid pump and the outflow port, and the supply path is connected to the circulation path at a position between the flow restricting unit and the liquid pump.

The liquid jet unit further includes an additional liquid jet head. The additional liquid jet head takes in liquid from the circulation path at a part between the inflow port and the liquid pump, and discharges liquid into the circulation path at a part between the outflow port and the flow restricting unit.

The supply path is connected to the flow path between the inflow port and the outflow port at a position near the outflow port.

The liquid jet unit further includes a flow restricting unit that causes pressure loss in liquid being circulated. The flow restricting unit is placed in the flow path between the inflow port and the outflow port at a position near the outflow port.

The supply path is connected to the flow path at a position between the flow restricting unit and the outflow port.

The pressure head of liquid supplied from the supply path is lower than the pressure head of liquid in the nozzle.

The supply path is connected to the circulation path at a position between the liquid pump and the inflow port.

The flow path resistance in the circulation path at a part between the vicinity of the inflow port and a connection point to which the supply path is connected is larger than the flow path resistance in the circulation path at a part between the outflow port and the liquid pump.

The liquid jet unit further includes a flow restricting unit that causes pressure loss in liquid being circulated. The flow restricting unit is placed in the circulation path at a position between the liquid pump and the inflow port, and the supply path is connected to the circulation path at a position between the liquid pump and the flow restricting unit.

The liquid jet unit further includes an additional liquid jet head. The additional liquid jet head takes in liquid from the circulation path at a part between the inflow port and the flow restricting unit, and discharges liquid into the circulation path at a part between the outflow port and the liquid pump.

The pressure head of liquid supplied from the supply path is higher than the pressure head of liquid in the nozzle.

The pressure sensor is placed in the circulation path at a position near the inflow port or the outflow port.

The liquid jet unit further includes a damper that reduces pressure fluctuation of liquid, and the pressure sensor is disposed in the damper.

The flow restricting unit includes a valve capable of changing the amount of pressure loss.

The supply path and the circulation path is connected to each other via a three-way valve, and the three-way valve can be switched between a three-way communicating state and a two-way communicating state in which one way of the circulation path communicates with the supply path and the other way of the circulation path is closed.

A liquid jet unit of a second aspect of the present invention includes a circulation path through which liquid is circulated; a liquid jet head that ejects liquid from a nozzle communicating with the circulation path; a liquid pump that circulates liquid in the circulation path; a supply path that supplies liquid to the circulation path; a flow restricting unit that causes pressure loss in liquid being circulated through the circulation path; and a pressure sensor that generates pressure information according to the pressure of liquid in the circulation path. The circulation path includes a first flow path and a second flow path which communicate between the liquid pump and the flow restricting unit in parallel. The liquid jet head and the pressure sensor are placed in the first flow path and the supply path is connected to the second flow path.

The liquid pump takes in liquid from the second flow path and feeds liquid to the first flow path, and the pressure head of liquid in the supply path is lower than the pressure head of liquid in the nozzle.

The liquid pump takes in liquid from the first flow path and feeds liquid to the second flow path, and the pressure head of liquid in the supply path is higher than the pressure head of liquid in the nozzle.

A liquid jet apparatus of the present invention includes any one of the above liquid jet units; a liquid tank that supplies liquid to the supply path; and a movement mechanism that relatively moves the liquid jet unit and a recording medium.

The liquid jet unit of the first aspect of the present invention includes a circulation path through which liquid is circulated; a liquid jet head that includes an inflow port and an outflow port, a flow path between the inflow port and the outflow port, the flow path constituting a part of the circulation path, and a nozzle communicating with the flow path, and ejects liquid from the nozzle; a liquid pump that is inserted into the circulation path, and circulates liquid in the circulation path; a supply path that is connected to the circulation path, and supplies liquid to the circulation path; and a pressure sensor that detects the pressure of liquid in the circulation path and generates pressure information. The liquid pump changes the amount of liquid to be fed on the basis of the pressure information to maintain liquid in the nozzle at a predetermined pressure and draw liquid into the circulation path from the supply path. Accordingly, the configuration of the circulation path through which liquid is circulated and the configuration of the supply path which supplies liquid to the circulation path are simplified. In addition, the range of allowable pressure head of liquid that is supplied to the circulation path from the supply path is extended.

DETAILED DESCRIPTION OF THE INVENTION

<First Aspect>

Figure 1:
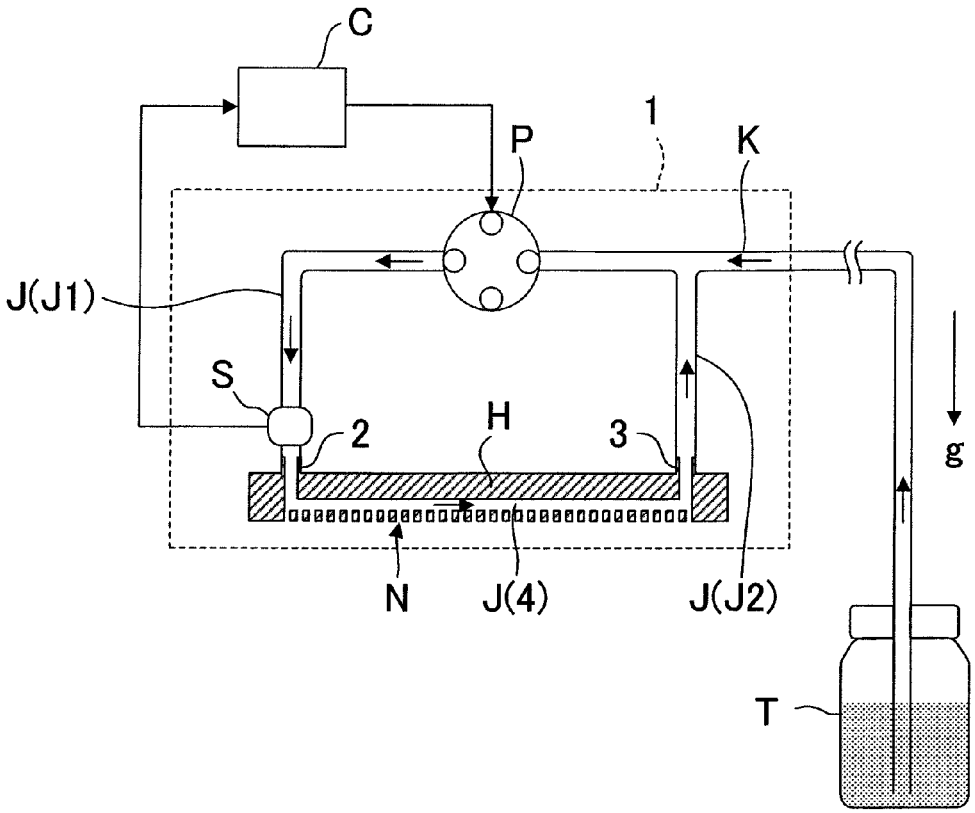
FIG. 1 is a schematic view illustrating the configuration of a liquid jet unit according to a first embodiment of the present invention.

A liquid jet unit according to the first aspect of the present invention is provided with a circulation path through which liquid is circulated, a liquid jet head that is inserted into the circulation path, a liquid pump that circulates liquid, a supply path that supplies liquid to the circulation path, and a pressure sensor that generates pressure information of liquid in the circulation path. The liquid jet head includes an inflow port and an outflow port for liquid. A flow path between the inflow port and the outflow port constitutes a part of the circulation path. The liquid jet head ejects liquid from a nozzle that communicates with the flow path. The liquid pump changes the amount of liquid to be fed on the basis of the pressure information to maintain liquid in the nozzle at a predetermined pressure and draw liquid into the circulation path from the supply path.

That is, the liquid pump placed in the circulation path circulates liquid in the circulation path, and supplies liquid to the circulation path from the supply path. More specifically, when liquid droplets are ejected from the nozzle of the liquid jet head, the amount of liquid inside the circulation path decreases. The pressure sensor detects the decrease in the amount of liquid as the reduction in the pressure of liquid, and thereby generates pressure information. On the basis of the pressure information, the liquid pump supplies liquid to the circulation path from the supply path while increasing or decreasing the liquid-feeding amount to thereby recover the reduced pressure and maintain the shape of a meniscus formed on the nozzle at a constant shape. For example, when the pressure head of liquid supplied from the supply path is lower than the pressure head of liquid in the nozzle, that is, when liquid in the supply path has negative pressure relative to liquid in the nozzle, liquid is drawn into the circulation path from the supply path by increasing the liquid-feeding amount. On the other hand, when the pressure head of liquid supplied from the supply path is higher than the pressure head of liquid in the nozzle, that is, when liquid in the supply path has positive pressure relative to liquid in the nozzle, liquid is drawn into the circulation path from the supply path by reducing the liquid-feeding amount.

In this manner, liquid is circulated through the liquid jet head, and the same amount of liquid as the liquid ejected from the nozzle is constantly supplied to the circulation path from the supply path by using the single liquid pump. Further, when supplying liquid to the circulation path from the liquid tank, it is not necessary to strictly control the relative position between the nozzle and the tank compared to the case where liquid is supplied to the circulation path from the liquid tank on the basis of the difference in potential head between the nozzle and the liquid tank. For example, when supplying liquid to the circulation path from the liquid tank through the supply path, it is enough to determine whether the liquid tank is located above or below the nozzle of the liquid jet head. Therefore, it is not necessary to strictly control the difference in height between the nozzle and the liquid tank. When the liquid tank is located above the nozzle, liquid can be supplied to the circulation path if the height of the liquid tank does not exceed an allowable maximum height thereof. Similarly, when the liquid tank is located below the nozzle, liquid can be supplied to the circulation path if the height of the liquid tank does not fall below an allowable minimum height thereof. When considering this by replacing the heights of the liquid tank and the nozzle with the pressures of liquid in the supply path and liquid in the nozzle, when the pressure head of liquid in the supply path is higher than the pressure head of liquid in the nozzle, liquid can be supplied to the circulation path from the supply path if the pressure head of liquid in the supply path does not exceed an allowable maximum value thereof. On the other hand, when the pressure head of liquid in the supply path is lower than the pressure head of liquid in the nozzle, liquid can be supplied to the circulation path from the supply path if the pressure head of liquid in the supply path does not fall below an allowable minimum value thereof. The allowable maximum value and the allowable minimum value of the pressure head are mainly determined according to the liquid-feeding ability of the liquid pump. Therefore, by using a liquid pump having a predetermined liquid-feeding ability, it is possible to set a sufficiently broad range of the pressure head of liquid that can be supplied to the circulation path.

As described above, liquid can be supplied to the circulation type liquid jet unit through the supply path. Therefore, the structure is simple, and the control of the pressure head of liquid supplied through the supply path is significantly relaxed. In other words, it is possible to configure a liquid jet unit with versatility. For example, when installing the liquid jet unit in a liquid jet apparatus, the liquid jet unit can be connected to the liquid tank through a single supply path. Further, the relative position between the liquid tank and the nozzle of the liquid jet head often varies in each liquid jet apparatus. However, since it is not necessary to strictly control the pressure head of liquid in the supply path in the liquid jet unit of the present invention, the liquid jet unit can be easily installed in any different types of liquid jet apparatuses. Hereinbelow, the present invention will be specifically described on the basis of embodiments thereof.

(First Embodiment)

FIG. 1 is a schematic view illustrating the configuration of a liquid jet unit 1 according to the first embodiment of the present invention. The liquid jet unit 1 is provided with a circulation path J through which liquid is circulated, a liquid jet head H which jets liquid from a nozzle N, a liquid pump P which circulates liquid in the circulation path J, a pressure sensor S which generates pressure information according to the pressure of liquid in the circulation path J, and a supply path K which supplies liquid to the circulation path J. The liquid jet head H includes an inflow port 2 and an outflow port 3. An interior flow path 4 between the inflow port 2 and the outflow port 3 constitutes a part of the circulation path J. The liquid jet head H ejects liquid from the nozzle N which communicates with the interior flow path 4. The pressure head of liquid in the supply path K is lower than the pressure head of liquid in the nozzle N. That is, one end of the supply path K is connected to a circulation path J2 between the outflow port 3 and the liquid pump P, and the other end thereof is connected to a liquid tank T which is placed in the main body of a liquid jet apparatus. The liquid tank T is located below the nozzle N in a gravity direction g. The pressure sensor S is placed in the circulation path J1 at a position near the inflow port 2. In this regard, the entire circulation path is generically referred to as the circulation path J. In the circulation path J, a circulation path between the liquid pump P and the inflow port 2 is referred to as the circulation path J1, and a circulation path between the outflow port 3 and the liquid pump P is referred to as the circulation path J2.

Liquid that is pressure-fed by the liquid pump P is circulated through the circulation path J1, the interior flow path 4, and the circulation path J2. The amount of liquid fed by the liquid pump P (hereinafter, referred to as "the liquid-feeding amount of the liquid pump P") is controlled by a control unit C on the basis of pressure information generated by the pressure sensor S. For example, when liquid droplets are not ejected from the nozzle N of the liquid jet head H, the liquid-feeding amount of the liquid pump P is controlled on the basis of the pressure information generated by the pressure sensor S so that the pressure of liquid in the interior flow path 4 becomes constant. As a result, liquid in the nozzle N is maintained at a predetermined pressure, and a meniscus of liquid formed on each opening portion of the nozzle N is maintained at a constant shape. When liquid droplets are ejected from the nozzle N of the liquid jet head H, the pressure of liquid near the inflow port 2 decreases. The pressure sensor S detects the pressure decrease, and generates pressure information. The control unit C controls the liquid pump P on the basis of the pressure information so that the liquid-feeding amount thereof increases. Accordingly, the pressure of liquid in the interior flow path 4 increases, and, at the same time, the pressure of liquid in the circulation path J2 decreases. As a result, liquid is drawn in from the supply path K, and the same amount of liquid as the ejected liquid is replenished.

Generally, flow path resistance exists in the interior flow path 4 of the liquid jet head H. Therefore, when liquid is circulated through the circulation path J, the pressure of liquid in the circulation path J2 becomes lower than the pressure of liquid in the circulation path J1, that is, pressure loss occurs. Therefore, it is possible to draw liquid into the circulation path J from the supply path K using the pressure loss. Further, flow path resistance exists in the circulation path J2 at a part between a connection point in the circulation path J2 to which the supply path K is connected and the outflow port 3. Due to this flow path resistance, pressure loss occurs in liquid circulated through the circulation path J. Therefore, it is possible to draw liquid into the circulation path J from the supply path K using the pressure loss.

For example, by increasing the flow path resistance in the circulation path J2 at a part between the vicinity of the outflow port 3 ("the vicinity of the outflow port 3" refers to a point in the interior flow path 4 which communicates with the nozzle N located at the most downstream position) and the supply path K, it is possible to increase the pressure loss, and thereby improve the drawing ability for drawing liquid from the supply path K. Specifically, a flow restricting unit that causes pressure loss is provided between the vicinity of the outflow port 3 and the supply path K to increase the flow path resistance. Alternatively, the flow path resistance in the circulation path J2 at the part between the vicinity of the outflow port 3 and the supply path K can be made larger than the flow path resistance in the circulation path J1 by applying the methods such as making the length of the part of the circulation path J2 between the vicinity of the outflow port 3 and the supply path K larger than the length of the circulation path J1; making the flow path cross section of the part of the circulation path J2 between the vicinity of the outflow port 3 and the supply path K smaller than the flow path cross section of the circulation path J1; and making the flow path cross section of the outflow port 3 smaller than the flow path cross section of the inflow port The liquid pump P may be a pump using a PZT actuator, and may also be a tube pump. In the case of a liquid jet head using a PZT actuator, it is also possible to use a liquid pump using a PZT actuator within the same chip (this can be applied to all of the following embodiments in the same manner). The pressure sensor S is desirably placed near the inflow port 2. However, the pressure sensor S may be placed in the interior flow path 4, and may also be placed near the outflow port 3. Although the pressure head of liquid in the supply path K is set to be lower than the pressure head of liquid in the nozzle N, it is not necessary to strictly control values of the pressure heads. For example, when the pressure sensor S placed in the circulation path J1 detects the decrease in the pressure of liquid, the control unit C increases the liquid-feeding amount of the liquid pump P on the basis of the pressure information to draw in liquid from the supply path K, thereby maintaining the interior flow path 4 at a predetermined pressure. Further, when the pressure sensor S detects the increase in the pressure of liquid, the control unit C reduces the liquid-feeding amount of the liquid pump P on the basis of the pressure information to restrict liquid to be drawn in from the supply path K, thereby maintaining the interior flow path 4 at a predetermined pressure.

In this manner, the circulation path J and the liquid tank T can be connected to each other through the single supply path K. Further, the circulation of liquid through the circulation path J and the supply of liquid from the liquid tank T can be performed by the single liquid pump P. Therefore, the structure of a flow path is extremely simplified. In addition, the range of allowable pressure head of liquid that is supplied to the circulation path J from the supply path K is extended.

In the above first embodiment, the liquid tank T is located below the nozzle N in the gravity direction g. However, even when the liquid tank T is located above the nozzle N in the gravity direction g, the present invention can be implemented. More specifically, in this case, in the liquid jet unit 1 illustrated in FIG. 1, the feeding direction of liquid from the liquid pump P can be reversed so that the liquid jet head H takes in liquid from the outflow port 3 and discharges liquid from the inflow port 2. In this example, the flow path resistance between the connection point in the circulation path J2 to which the supply path K is connected and the vicinity of the outflow port 3 (the liquid inflow side in this example) is utilized in the same manner as in the first embodiment. Specifically, when liquid droplets are ejected from the liquid jet head H, and the pressure sensor S thereby detects the decrease in the pressure of liquid and generates pressure information, the control unit C controls the liquid pump P on the basis of the pressure information so that the liquid-feeding amount thereof decreases. Accordingly, the pressure of liquid in the interior flow path 4 increases, and, at the same time, the pressure of liquid in the circulation path J2 decreases. As a result, liquid is drawn into the circulation path J2 from the supply path K.

(Second Embodiment)

Figure 2:
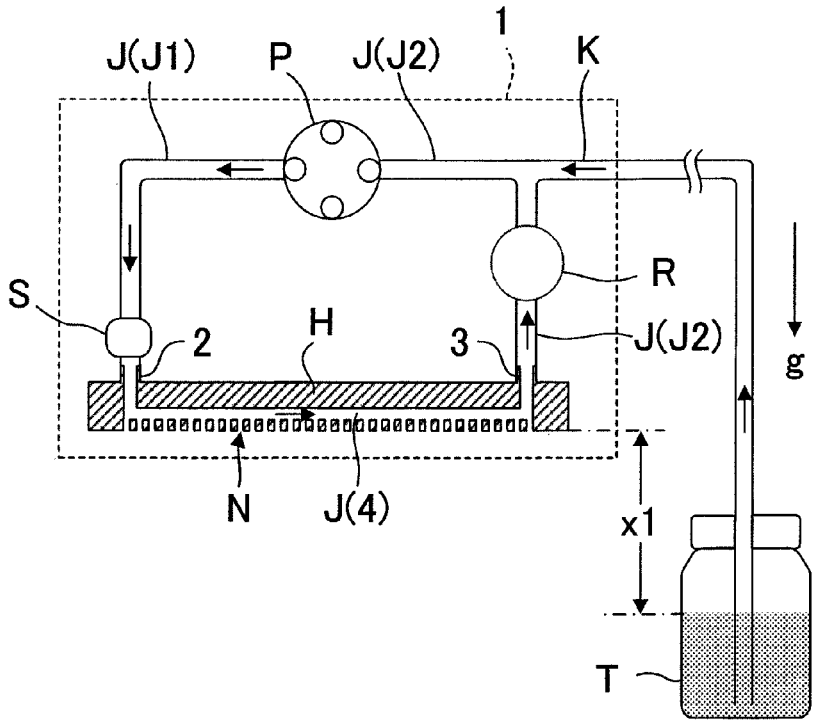
FIG. 2 is a schematic view illustrating the configuration of a liquid jet unit according to a second embodiment of the present invention.

FIG. 2 is a schematic view illustrating the configuration of a liquid jet unit 1 according to the second embodiment of the present invention. The primary difference from the first embodiment is that a flow restricting unit R is placed between the outflow port 3 and the supply path K. The same components or components having the same function are denoted by the same signs as those in the first embodiment.

As illustrated in FIG. 2, the liquid jet unit 1 is provided with a circulation path J through which liquid is circulated, a liquid jet head H which jets liquid from a nozzle N, a liquid pump P which circulates liquid in the circulation path J, a pressure sensor S which generates pressure information according to the pressure of liquid in the circulation path J, a supply path K which supplies liquid to the circulation path J, and the flow restricting unit R which causes pressure loss in liquid being circulated. The liquid jet head H includes an inflow port 2 and an outflow port 3. An interior flow path 4 between the inflow port 2 and the outflow port 3 constitutes a part of the circulation path J. The liquid jet head H ejects liquid from the nozzle N which communicates with the interior flow path 4. The pressure sensor S is placed in a circulation path J1 at a position near the inflow port 2, and generates pressure information on the basis of the pressure of liquid inside thereof. The flow restricting unit R is placed in a circulation path J2 between the outflow port 3 and the liquid pump P. The supply path K is connected to the circulation path J2 at a position between the flow restricting unit R and the liquid pump P. One end of the supply path K is connected to the circulation path J2, and the other end thereof is connected to a liquid tank T which is placed in the main body of a liquid jet apparatus. The liquid tank T is located below the nozzle N in the gravity direction g by a height x1. Therefore, the pressure head of liquid in the supply path K becomes lower than the pressure head of liquid in the nozzle N by a value corresponding to the height x1.

Liquid that is pressure-fed by the liquid pump P is circulated through the circulation path J1, the interior flow path 4, and the circulation path J2. Since the flow restricting unit R is placed in the circulation path J2, the flow path resistance therein increases. Therefore, when liquid is circulated, the pressure of liquid at the downstream side of the flow restricting unit R (liquid in a part of the circulation path J2 between the flow restricting unit R and the liquid pump P) becomes lower than the pressure of liquid at the upstream side thereof (liquid in a part of the circulation path J2 between the liquid jet head H and the flow restricting unit R). Further, when liquid is circulated, the pressure of liquid in the interior flow path 4 of the liquid jet head H is higher than the pressure of liquid in the circulation path J2 to which the supply path K is connected. The liquid-feeding amount of the liquid pump P is controlled on the basis of pressure information generated by the pressure sensor S so that the pressure of liquid in the nozzle N becomes a predetermined pressure. Liquid is drawn into the circulation path J2 from the supply path K according to the liquid-feeding amount of the liquid pump P. That is, the liquid pump P maintains liquid in the nozzle N at a predetermined pressure by changing the liquid-feeding amount on the basis of the pressure information, and draws liquid into the circulation path J2 from the supply path K.

For example, when liquid droplets are not ejected from the nozzle N of the liquid jet head H, the liquid-feeding amount of the liquid pump P is controlled on the basis of the pressure information generated by the pressure sensor S so that the pressure of liquid in the interior flow path 4 becomes constant. As a result, liquid in the nozzle N is maintained at a predetermined pressure, and a meniscus of liquid formed on each opening portion of the nozzle N is maintained at a constant shape. When liquid droplets are ejected from the nozzle N of the liquid jet head H, the pressure of liquid in the interior flow path 4 decreases. The pressure sensor S detects the pressure decrease, and generates pressure information. A control unit (not illustrated) controls the liquid pump P on the basis of the pressure information so that the liquid-feeding amount thereof increases. Accordingly, the pressure of liquid in the interior flow path 4 increases, and, at the same time, the pressure of liquid at the downstream side of the flow restricting unit R (liquid in a part of the circulation path J2 between the flow restricting unit R and the liquid pump P) decreases. When the pressure (pressure head) of liquid at the downstream side of the flow restricting unit R becomes lower than the pressure (pressure head) of liquid in the supply path K, liquid is drawn into the circulation path J2 from the liquid tank T through the supply path K, and the same amount of liquid as the ejected liquid is replenished.

The liquid pump P may be a pump using a PZT actuator, and may also be a tube pump. The pressure sensor S is desirably placed near the inflow port 2. However, the pressure sensor S may be placed in the interior flow path 4, and may also be placed in the circulation path J2 at a position between the outflow port 3 and the flow restricting unit R. Further, the pressure head of liquid supplied from the supply path K needs to be lower than the pressure head of liquid in the nozzle N. In other words, the liquid tank T needs to be located below the nozzle N in the gravity direction g. In this manner, the circulation path J and the liquid tank T can be connected to each other through at least the single supply path K. Further, the circulation and supply of liquid can be performed by the single liquid pump P. Therefore, the structure is extremely simplified. In addition, the range of allowable pressure head of liquid that is supplied to the circulation path J from the supply path K is extended. That is, limitation of the difference in height between the nozzle N and the liquid tank T is significantly relaxed.

A valve capable of varying the cross-sectional area of the flow path thereof can be used as the flow restricting unit R. By varying the cross-sectional area of the flow path of the valve, the amount of liquid to be circulated can be adjusted. Further, it is possible to easily set the liquid jet unit 1 to be an optimal state by adjusting the cross-sectional area of the flow path of the valve according to the difference in pressure head between liquid in the nozzle N and liquid in the supply path K.

Alternatively, a valve with a closing function for blocking the flow of liquid can be used as the flow restricting unit R. By using a valve with a closing function as the flow restricting unit R, it is possible to easily draw up liquid from the liquid tank T when the operation of the liquid jet unit 1 is resumed. More specifically, when an interior flow path of the flow restricting unit R is opened while the operation of the liquid jet unit 1 is stopped, liquid in the circulation path J is returned to the liquid tank T due to the difference in height between the opened nozzle N and the liquid tank T. In other words, since the pressure head of liquid in the supply path K is lower than the pressure head of liquid in the nozzle N, the liquid in the nozzle N and the liquid in the circulation path J are drawn out toward the liquid tank T. Thereafter, when the operation of the liquid jet unit 1 is resumed, the liquid pump P is driven. However, since the flow path of the flow restricting unit R is opened, the liquid pump P cannot draw up liquid from the liquid tank T by removing air from the nozzle N through the interior flow path 4 and the circulation path J2. Therefore, the flow path of the flow restricting unit R is closed when the operation of the liquid jet unit 1 is stopped or the operation of the liquid jet unit 1 is resumed. As a result, since the flow restricting unit R is closed when the liquid jet unit 1 is caused to operate, it is possible to draw up liquid from the liquid tank T through the supply path K.

(Third Embodiment)

Figure 3:
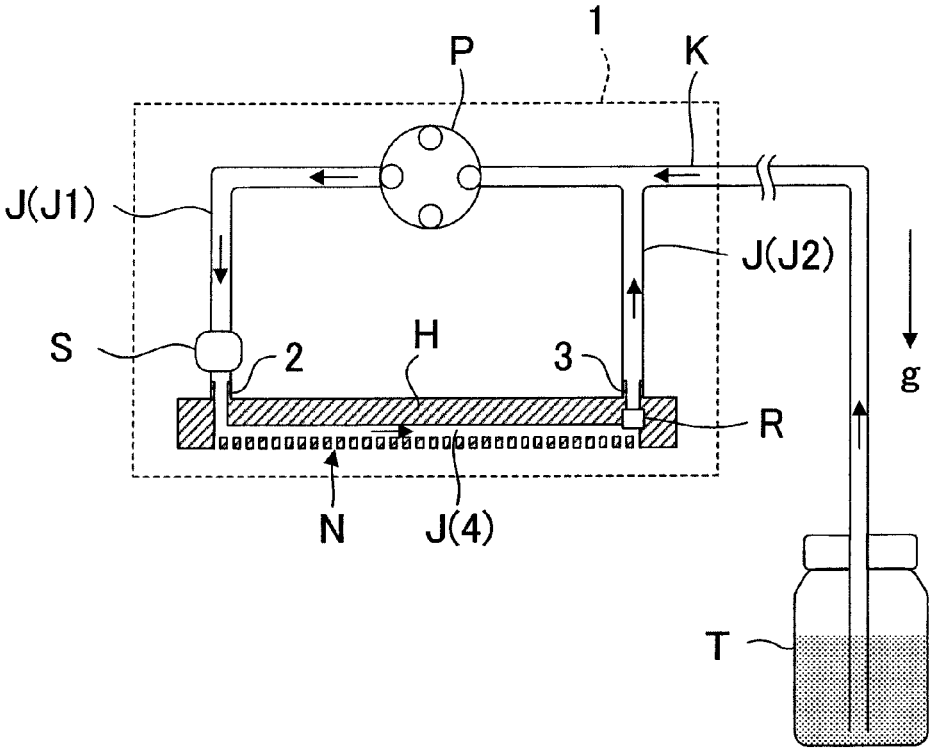
FIG. 3 is a schematic view illustrating the configuration of a liquid jet unit according to a third embodiment of the present invention.

FIG. 3 is a schematic view illustrating the configuration of a liquid jet unit 1 according to the third embodiment of the present invention. The difference from the second embodiment is that the flow restricting unit R is placed in the interior flow path 4 inside the liquid jet head H. The other configurations are the same as those of the second embodiment. Therefore, hereinbelow, only differences from the second embodiment will be described, and the descriptions of the same points will be omitted.

As illustrated in FIG. 3, the flow restricting unit R is placed in the interior flow path 4 between the inflow port 2 and the outflow port 3, particularly at a position near the outflow port 3. The other configurations are the same as those of the second embodiment. By using a valve with a closing function as the flow restricting unit R in such a configuration, it is possible to achieve an effect that cannot be achieved by the liquid jet unit 1 of the second embodiment. As already described in the second embodiment, by adding a closing function to the flow restricting unit R, it is possible to easily draw up liquid from the liquid tank T when the operation of the liquid jet unit 1 is resumed.

In the present embodiment, in addition to the above effect, the interior flow path 4 can be filled with liquid without air bubbles remaining therein when resuming the operation of the liquid jet unit 1. More specifically, the flow path of the flow restricting unit R is closed when the operation of the liquid jet unit 1 is stopped. An interior flow path of the liquid pump P is opened when the operation of the liquid jet unit 1 is stopped, and liquid is thereby returned to the liquid tank T from the interior flow path 4 of the liquid jet head H through the circulation path J1. However, since the flow restricting unit R is closed, liquid remains in a part of the circulation path J2 between the flow restricting unit R and the supply path K. Then, the liquid pump P is caused to operate when the operation of the liquid jet unit 1 is resumed. Accordingly, liquid is drawn up from the liquid tank T through the supply path K and the circulation path J2, and filled into the interior flow path 4 of the liquid jet head H without air bubbles remaining therein. The other operations and effects are the same as those of the second embodiment, and descriptions thereof will therefore be omitted.

(Fourth Embodiment)

Figure 4:
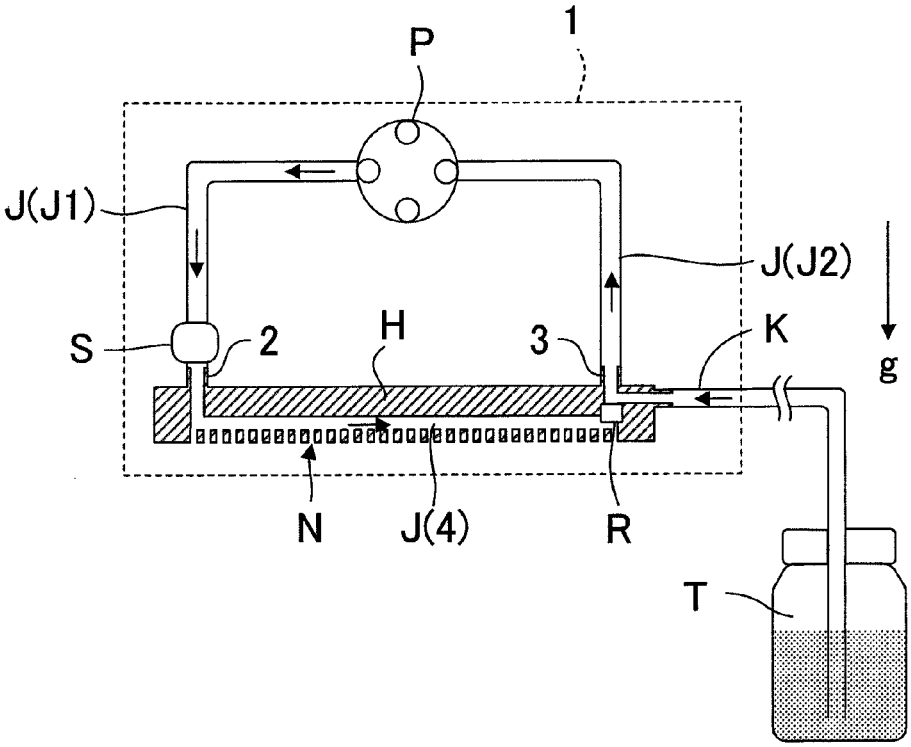
FIG. 4 is a schematic view illustrating the configuration of a liquid jet unit according to a fourth embodiment of the present invention.

FIG. 4 is a schematic view illustrating the configuration of a liquid jet unit 1 according to the fourth embodiment of the present invention. The difference from the third embodiment is that the supply path K is connected to the interior flow path 4 at a position between the flow restricting unit R and the outflow port 3. The other configurations are the same as those of the third embodiment. Therefore, hereinbelow, only differences from the third embodiment will be described, and the descriptions of the same points will be omitted.

As illustrated in FIG. 4, the supply path K is connected to the interior flow path 4 at the position between the flow restricting unit R and the outflow port 3. Since the flow restricting unit R is placed near the outflow port 3, the flow restricting unit R is placed near the supply path K and the outflow port 3. The other configurations are the same as those of the third embodiment. By using a valve with a closing function as the flow restricting unit R in such a configuration, it is possible to achieve an effect that cannot be achieved by the liquid jet unit 1 of the third embodiment. As already described in the third embodiment, by closing the interior flow path of the flow restricting unit R when the operation of the liquid jet unit 1 is stopped or resumed, it is possible to fill the interior flow path 4 with liquid without air bubbles remaining therein when the operation of the liquid jet unit 1 is resumed.

In the present embodiment, in addition to the above effect, liquid can be drawn out from the interior flow path 4, the circulation path J1, and the circulation path J2 when the liquid jet unit 1 is stopped. First, the flow path of the flow restricting unit R is closed after stopping the operation of the liquid jet unit 1. When the interior flow path of the liquid pump P is opened when the operation of the liquid jet unit 1 is stopped, since the pressure head of liquid in the supply path K is lower than the pressure head of liquid in the nozzle N, liquid is drawn out toward the supply path K from the interior flow path 4, the circulation path J1, the liquid pump P, and the circulation path J2. Therefore, liquid does not remain inside the liquid jet unit 1.

When the operation of the liquid jet unit 1 is resumed, the liquid pump P is caused to operate. Accordingly, liquid is filled into the interior flow path 4 from the supply path K through the circulation path J2, the liquid pump P, and the circulation path J1. In this manner, liquid inside the liquid jet unit 1 is returned toward the liquid tank T when the operation of the liquid jet unit 1 is stopped. On the other hand, the interior flow path 4 of the liquid jet head H can be filled with liquid without air bubbles remaining therein when the operation of the liquid jet unit 1 is resumed. The other operations and effects are the same as those of the second and third embodiments, and descriptions thereof will therefore be omitted.

(Fifth Embodiment)

Figure 5:
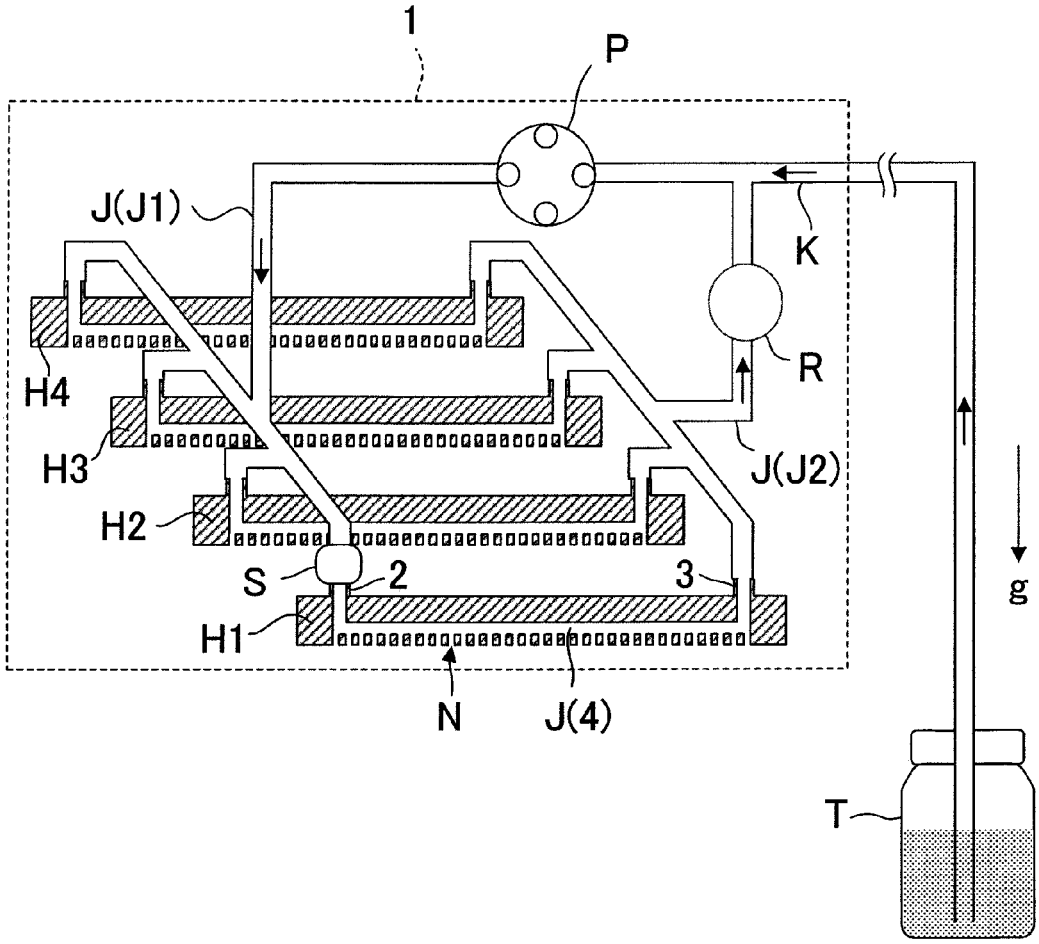
FIG. 5 is a schematic view illustrating the configuration of a liquid jet unit according to a fifth embodiment of the present invention.

FIG. 5 is a schematic view illustrating the configuration of a liquid jet unit 1 according to the fifth embodiment of the present invention. The difference from the second embodiment is that the liquid jet unit 1 includes a plurality of liquid jet heads H1 to H4. The same components or components having the same function are denoted by the same signs as those in the second embodiment.

The liquid jet unit 1 is provided with a circulation path J, the plurality of liquid jet heads H1 to H4, a supply path K which supplies liquid to the circulation path J, a pressure sensor S which generates pressure information according to the pressure of liquid in the circulation path J, and a flow restricting unit R which causes pressure loss in liquid being circulated. The liquid jet head H1 includes an inflow port 2 and an outflow port 3. An interior flow path 4 between the inflow port 2 and the outflow port 3 constitutes a part of the circulation path J. The liquid jet head H1 ejects liquid from a nozzle N which communicates with the interior flow path 4. Each of the other liquid jet heads H2 to H4 has the same structure as the liquid jet head H1.

One end of a circulation path J1 is connected to an outlet side of the liquid pump P. The circulation path J1 branches in the midway part thereof, and ends of the respective branches of the circulation path J1 are connected to the inflow ports 2 of the respective liquid jet heads H1 to H4. One end of a circulation path J2 branches, and ends of the respective branches of the circulation path J2 are connected to the outflow ports 3 of the respective liquid jet heads H1 to H4. The branches of the circulation path J2 are joined together in the midway part thereof, and the end of the joined circulation path J2 is connected to an inlet side of the liquid pump P. The pressure sensor S is placed in the circulation path J1 at a position near the inflow port 2 of the liquid jet head H1. The flow restricting unit R is placed between the liquid pump P and the junction of the branches of the circulation path J2 at the outflow side of the respective liquid jet heads H1 to H4. The supply path K is connected to the circulation path J2 at a position between the flow restricting unit R and the liquid pump P. That is, in the circulation path J passing through the liquid pump P, the circulation path J1, the liquid jet head H1, and the circulation path J2, the flow restricting unit R is placed in the circulation path J2 between the liquid pump P and the outflow port 3 of the liquid jet head H1, the supply path K is connected to the circulation path J2 at the position between the flow restricting unit R and the liquid pump P, and the pressure sensor S is placed in the circulation path J1 at the position near the inflow port 2 of the liquid jet head H1. Each of the liquid jet heads H2 to H4 takes in liquid from the circulation path J1 at a part between the inflow port 2 of the liquid jet head H1 and the liquid pump P, and discharges liquid into the circulation path J2 at a part between the outflow port 3 of the liquid jet head H1 and the flow restricting unit R.

The pressure head of liquid in the supply path K is lower than the pressure head of liquid in the nozzle N of each of the liquid jet heads H1 to H4. That is, when one end of the supply path K is connected to the circulation path J2, and the other end thereof is connected to a liquid tank T which is placed in the main body of a liquid jet apparatus, the liquid tank T is located below all of the nozzles N of the respective liquid jet heads H1 to H4 in the gravity direction g.

Liquid that is pressure-fed from the liquid pump P is circulated through the circulation path J1, the interior flow paths 4 of the respective liquid jet heads H1 to H4, and the circulation path J2. When liquid is ejected from any one of the nozzles N of the respective liquid jet heads H1 to H4, the pressure of liquid near the inflow port 2 of the liquid jet head H1 decreases. The pressure sensor S detects the pressure decrease, and generates pressure information. A control unit (not illustrated) controls the liquid pump P on the basis of the pressure information so that the liquid-feeding amount thereof increases. Accordingly, the pressure of liquid in each of the interior flow paths 4, namely, the pressure of liquid in each of the nozzles N increases, and, at the same time, the pressure of liquid in the circulation path J2 decreases. As a result, liquid is drawn into the circulation path J2 from the supply path K.

When the plurality of liquid jet heads H1 to H4 ejects the same liquid in this manner, the liquid jet unit 1 and the liquid tank T which is provided in the main body of the liquid jet apparatus can be connected to each other through the single supply path K, and the circulation and supply of liquid can be performed by the single liquid pump P. Therefore, the structure is extremely simplified. In addition, since limitation of the difference in pressure head between the nozzle N and the supply path K is relaxed, the liquid jet heads H can be easily installed in any liquid jet apparatuses in which installation conditions of the liquid tank T are different. The number of liquid jet heads H is not limited to four, and can be smaller or larger than four.

(Sixth Embodiment)

Figure 6:
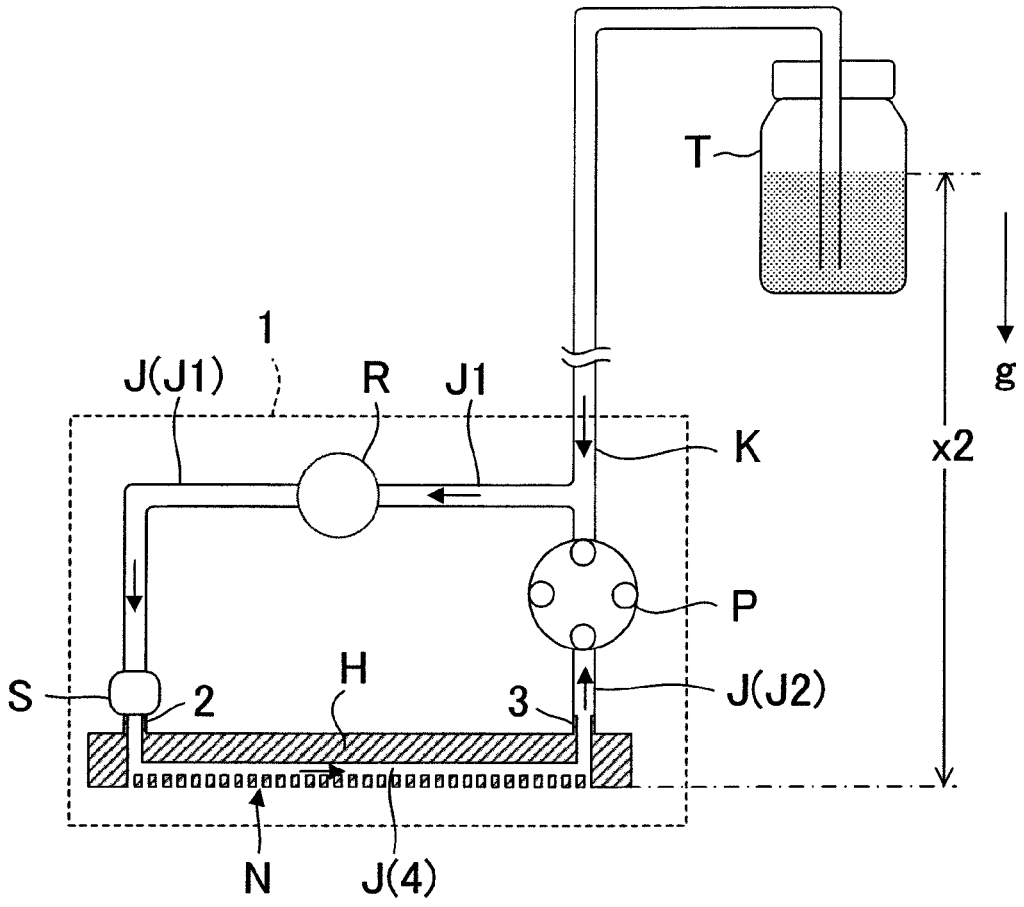
FIG. 6 is a schematic view illustrating the configuration of a liquid jet unit according to a sixth embodiment of the present invention.

FIG. 6 is a schematic view illustrating the configuration of a liquid jet unit 1 according to the sixth embodiment of the present invention. The difference from the first to fifth embodiments is that the flow restricting unit R is placed at the outlet side of the liquid pump P. The same components or components having the same function are denoted by the same signs as those in the first to fifth embodiments.

As illustrated in FIG. 6, the liquid jet unit 1 is provided with a circulation path J through which liquid is circulated, a liquid jet head H which jets liquid from a nozzle N, a liquid pump P which circulates liquid in the circulation path J, a pressure sensor S which generates pressure information according to the pressure of liquid in the circulation path J, a supply path K which supplies liquid to the circulation path J, and the flow restricting unit R which causes pressure loss in liquid being circulated. The liquid jet head H includes an inflow port 2 and an outflow port 3. An interior flow path 4 between the inflow port 2 and the outflow port 3 constitutes a part of the circulation path J. The liquid jet head H ejects liquid from the nozzle N which communicates with the interior flow path 4. The pressure sensor S is placed in a circulation path J1 at a position near the inflow port 2, and generates pressure information on the basis of the pressure of liquid inside thereof. The flow restricting unit R is placed in the circulation path J1 between the liquid pump P and the inflow port 2. The supply path K is connected to the circulation path J1 at a position between the flow restricting unit R and the liquid pump P. The pressure head of liquid in the supply path K is higher than the pressure head of liquid in the nozzle N. For example, one end of the supply path K is connected to the circulation path J1, and the other end thereof is connected to a liquid tank T which is placed in the main body of a liquid jet apparatus. In this case, the liquid tank T is located above the nozzle N in the gravity direction g by a height ×2. Therefore, the pressure head of liquid in the supply path K becomes higher than the pressure head of liquid in the nozzle N by a value corresponding to the height ×2.

Liquid that is pressure-fed by the liquid pump P is circulated through the circulation path J1, the interior flow path 4, and the circulation path J2. Since the flow restricting unit R is placed in the circulation path J1, the flow path resistance therein increases. Therefore, when liquid is circulated, the pressure of liquid at the upstream side of the flow restricting unit R (liquid in a part of the circulation path J1 between the liquid pump P and the flow restricting unit R) becomes larger than the pressure of liquid at the downstream side thereof (liquid in a part of the circulation path J1 between the flow restricting unit R and the inflow port 2). Further, when liquid is circulated, the pressure of liquid in the circulation path J1 to which the supply path K is connected is higher than the pressure of liquid in the interior flow path 4 of the liquid jet head H. The liquid-feeding amount of the liquid pump P is controlled on the basis of pressure information generated by the pressure sensor S so that the pressure of liquid in the nozzle N becomes a predetermined pressure. Liquid is drawn into the circulation path J1 from the supply path K according to the liquid-feeding amount of the liquid pump P. That is, the liquid pump P maintains liquid in the nozzle N at a predetermined pressure by changing the liquid-feeding amount on the basis of the pressure information, and draws liquid into the circulation path J1 from the supply path K.

For example, when liquid droplets are not ejected from the nozzle N of the liquid jet head H, the liquid-feeding amount of the liquid pump P is controlled on the basis of the pressure information generated by the pressure sensor S so that the pressure of liquid in the interior flow path 4, namely, the pressure of liquid in the nozzle N becomes constant. As a result, a meniscus of liquid formed on each opening portion of the nozzle N is maintained at a constant shape. When liquid droplets are ejected from the nozzle N of the liquid jet head H, the pressure of liquid in the interior flow path 4 decreases. The pressure sensor S detects the pressure decrease, and generates pressure information. A control unit (not illustrated) controls the liquid pump P on the basis of the pressure information so that the liquid-feeding amount thereof decreases. Accordingly, the amount of liquid sucked from the interior flow path 4 through the circulation path J2 decreases, and the pressure of liquid in the interior flow path 4 thereby increases. At the same time, the pressure of liquid in the circulation path J1 to which the supply path K is connected decreases. When the pressure of liquid in the circulation path J1 becomes lower than the pressure of liquid in the supply path K, liquid is drawn into the circulation path J1 from the liquid tank T through the supply path K, and the same amount of liquid as the ejected liquid is replenished.

The liquid pump P may be a pump using a PZT actuator, and may also be a tube pump. The pressure sensor S is desirably placed near the inflow port 2. However, the pressure sensor S may be placed in the interior flow path 4, and may also be placed between the outflow port 3 and the liquid pump P. Further, the pressure head of liquid supplied from the supply path K needs to be higher than the pressure head of liquid in the nozzle N. In other words, the liquid tank T needs to be located above the nozzle N in the gravity direction g. In this manner, the circulation path J and the liquid tank T can be connected to each other through at least the single supply path K. Further, the circulation and supply of liquid can be performed by the single liquid pump P. Therefore, the structure is extremely simplified. In addition, the range of allowable pressure head of liquid that is supplied to the circulation path J from the supply path K is extended. That is, limitation of the difference in height between the nozzle N and the liquid tank T is significantly relaxed.

Further, a valve with a closing function for blocking the flow of liquid can be used as the flow restricting unit R. When a pump, the interior flow path of which is closed when the feeding of liquid is stopped, is used as the liquid pump P, by stopping the operation of the liquid jet unit 1 and setting the flow restricting unit R to be a closed state, it is possible to prevent liquid inside the liquid tank T from leaking out from the nozzle N. Further, a valve capable of varying the cross-sectional area of the flow path thereof can be used as the flow restricting unit R. By varying the cross-sectional area of the flow path of the flow restricting unit R, even when the pressure head of liquid in the supply path K and the pressure head of liquid in the nozzle N are different from each other, it is possible to easily set the liquid jet unit 1 to be an optimal state.

(Seventh Embodiment)

Figure 7:
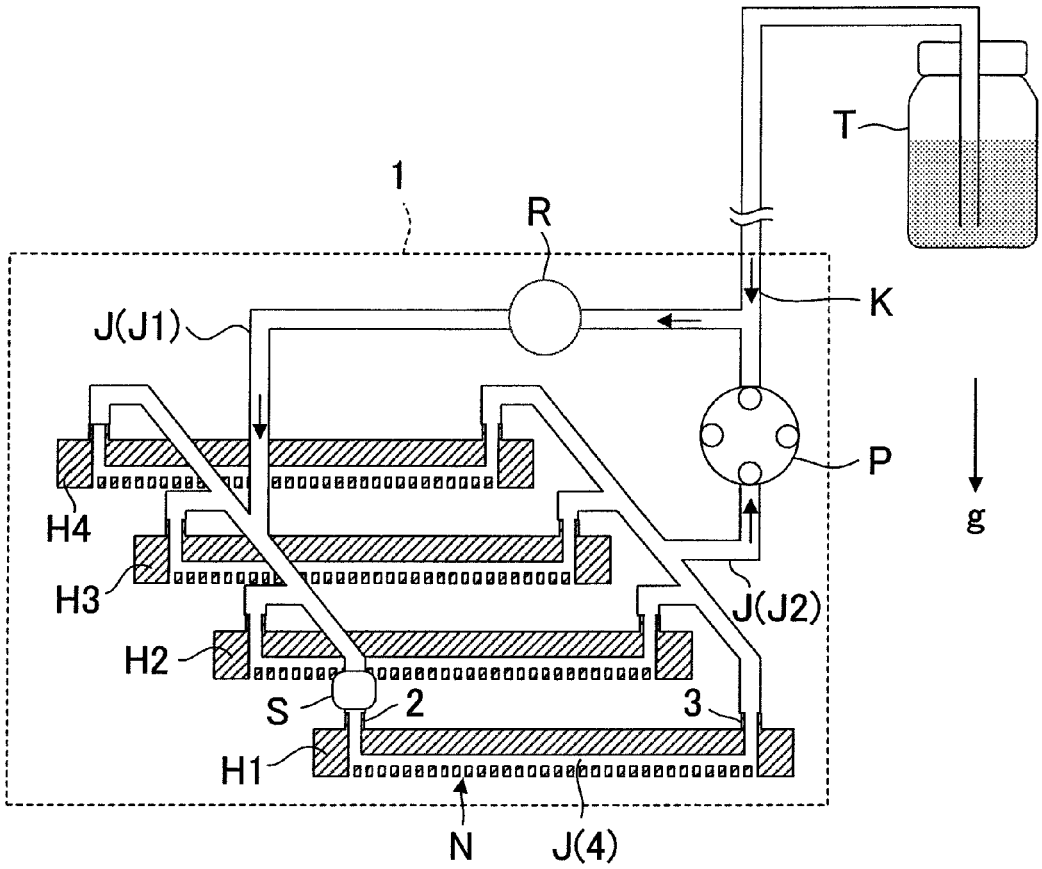
FIG. 7 is a schematic view illustrating the configuration of a liquid jet unit according to a seventh embodiment of the present invention.

FIG. 7 is a schematic view illustrating the configuration of a liquid jet unit 1 according to the seventh embodiment of the present invention. The difference from the sixth embodiment is that the liquid jet unit 1 includes a plurality of liquid jet heads H1 to H4. The same components or components having the same function are denoted by the same signs as those in the sixth embodiment.

The liquid jet unit 1 is provided with a circulation path J, the plurality of liquid jet heads H1 to H4, a supply path K which supplies liquid to the circulation path J, a pressure sensor S which generates pressure information according to the pressure of liquid in the circulation path J, and a flow restricting unit R which causes pressure loss in liquid being circulated. The liquid jet head H1 includes an inflow port 2 and an outflow port 3. An interior flow path 4 between the inflow port 2 and the outflow port 3 of the liquid jet head H1 constitutes a part of the circulation path J. The liquid jet head H1 ejects liquid from a nozzle N which communicates with the interior flow path 4. Each of the other liquid jet heads H2 to H4 has the same structure as the liquid jet head H1.

One end of a circulation path J1 is connected to the outlet side of the liquid pump P. The circulation path J1 branches in the midway part thereof, and ends of the respective branches of the circulation path J1 are connected to the inflow ports 2 of the respective liquid jet heads H1 to H4. One end of a circulation path J2 branches, and ends of the respective branches of the circulation path J2 are connected to the outflow ports 3 of the respective liquid jet heads H1 to H4. The branches of the circulation path J2 are joined together in the midway part thereof, and the end of the joined circulation path J2 is connected to an inlet side of the liquid pump P. The pressure sensor S is placed in the circulation path J1 at a position near the inflow port 2 of the liquid jet head H1. The flow restricting unit R is placed in the circulation path J1 at a position between a branch point at which liquid flowing into the respective liquid jet heads H1 to H4 branches and the liquid pump P. The supply path K is connected to the circulation path J1 at a position between the liquid pump P and the flow restricting unit R. Each of the liquid jet heads H2 to H4 takes in liquid from the circulation path J1 at a part between the inflow port 2 of the liquid jet head H1 and the flow restricting unit R, and discharges liquid into the circulation path J2 at a part between the outflow port 3 of the liquid jet head H1 and the liquid pump P.

The pressure head of liquid in the supply path K is higher than the pressure head of liquid in the nozzle N of each of the liquid jet heads H1 to H4. That is, when one end of the supply path K is connected to the circulation path J1, and the other end thereof is connected to a liquid tank T which is placed in the main body of a liquid jet apparatus, the liquid tank T is located above all of the nozzles N of the respective liquid jet heads H1 to H4 in the gravity direction g.

Liquid that is pressure-fed from the liquid pump P is circulated through the circulation path J1, interior flow paths 4 of the respective liquid jet heads H1 to H4, and the circulation path J2. When liquid is ejected from any one of the nozzles N of the respective liquid jet heads H1 to H4, the pressure of liquid near the inflow port 2 of the liquid jet head H1 decreases. The pressure sensor S detects the pressure decrease, and generates pressure information. A control unit (not illustrated) controls the liquid pump P on the basis of the pressure information so that the liquid-feeding amount thereof decreases. Accordingly, the pressure of liquid in each of the interior flow paths 4 increases, and, at the same time, the pressure of liquid in the circulation path J1 decreases. As a result, liquid is drawn into the circulation path J1 from the supply path K.

When the plurality of liquid jet heads H1 to H4 ejects the same liquid in this manner, the liquid jet unit 1 and the liquid tank T which is provided in the main body of the liquid jet apparatus can be connected to each other through the single supply path K, and the circulation and supply of liquid can be performed by the single liquid pump P. Therefore, the structure is extremely simplified. In addition, since limitation of the difference in pressure head between the nozzle N and the supply path K is relaxed, the liquid jet heads H can be easily installed in any liquid jet apparatuses in which installation conditions of the liquid tank T are different. The number of liquid jet heads H is not limited to four, and can be smaller or larger than four.

(Eighth Embodiment)

Figure 8:
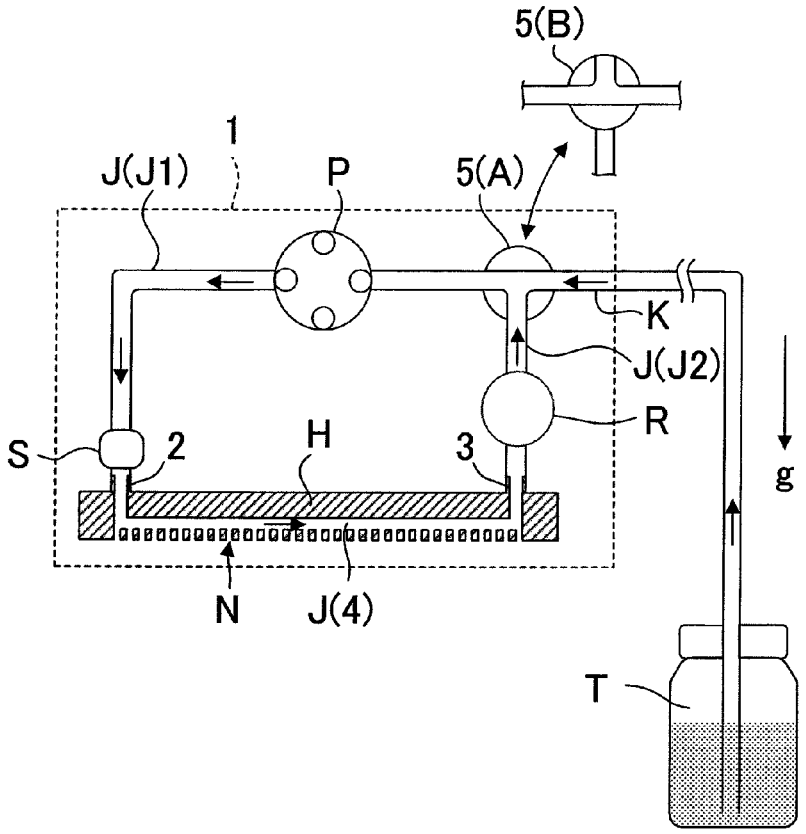
FIG. 8 is a schematic view illustrating the configuration of a liquid jet unit according to an eighth embodiment of the present invention.

FIG. 8 is a schematic view illustrating the configuration of a liquid jet unit 1 according to the eighth embodiment of the present invention. The difference from the second embodiment is that a three-way valve 5 is used at a connection point at which the supply path K is connected to the circulation path J2. The other configurations are the same as those of the second embodiment. Therefore, hereinbelow, only differences from the second embodiment will be described, and the descriptions of the same points will be omitted. The same components or components having the same function are denoted by the same signs as those in the second embodiment.

As illustrated in FIG. 8, the supply path K and the circulation path J2 are connected to each other via the three-way valve 5. The three-way valve 5 can be switched between a state A as a three-way communicating state and a state B as a two-way communicating state in which a part of the circulation path J2 between the three-way valve 5 and the liquid pump P and the supply path K communicate with each other. When the liquid jet unit 1 is in operation, the three-way valve 5 is set to be the state A as the three-way communicating state. When the liquid jet unit 1 is in a stopped state, the three-way valve 5 is set to be the state B. In this case, when the liquid pump P is in a stopped state and an interior flow path thereof is opened, liquid in the interior flow path 4 and the circulation path J1 is returned toward the liquid tank T. By resuming the operation of the liquid jet unit 1 while the three-way valve 5 remains in the state B, the liquid pump P can suck liquid from the liquid tank T through the supply path K. On the other hand, when the liquid pump P is in a stopped state and the interior flow path thereof is closed, it is possible to promptly fill the interior flow path 4 with liquid from the liquid pump P through the circulation path J1 when the operation of the liquid jet unit 1 is resumed. The three-way valve 5 can also be applied to the connection point between the circulation path J2 and the supply path K of each of the liquid jet units 1 of the first, and third to fifth embodiments.

Further, the three-way valve 5 can be applied to the connection point between the circulation path J1 and the supply path K of each of the liquid jet units 1 of the sixth and seventh embodiments. In this case, when the liquid jet unit 1 is in operation, the three-way valve 5 is set to be the state A as the three-way communicating state. When the liquid jet unit 1 is in a stopped state, the three-way valve 5 is set to be the state B in which the supply path K and a part of the circulation path J1 between the three-way valve 5 and the liquid pump P communicate with each other. When the liquid pump P is in a stopped state and the interior flow path thereof is closed, liquid is prevented from flowing into the interior flow path 4 of the liquid jet head H from the liquid tank T.

(Ninth Embodiment)

Figure 9:
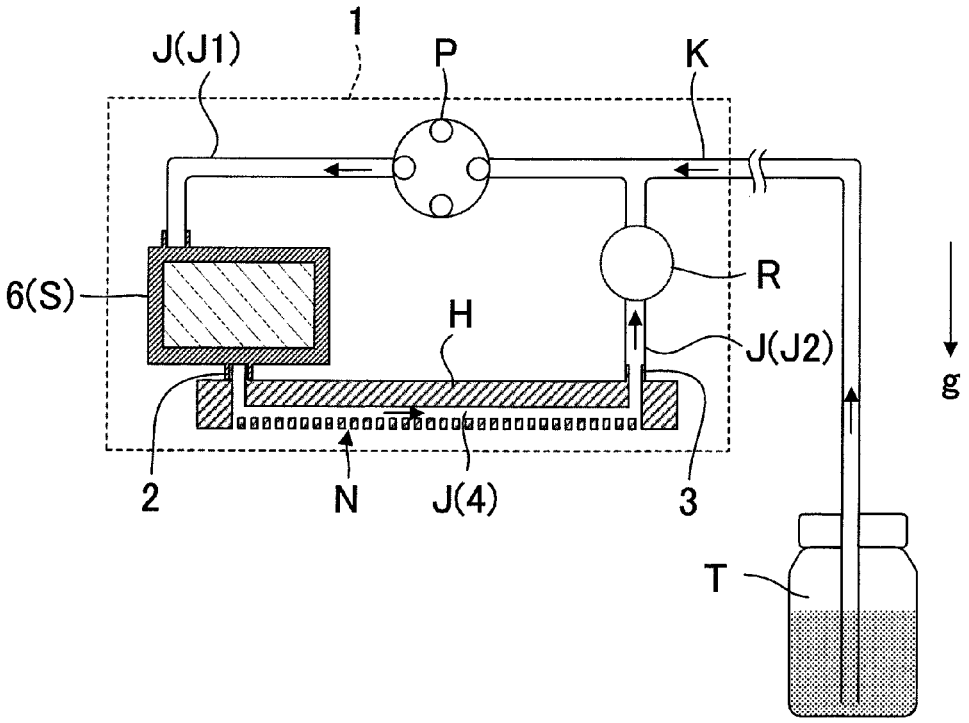
FIG. 9 is a schematic view illustrating the configuration of a liquid jet unit according to a ninth embodiment of the present invention.

FIG. 9 is a schematic view illustrating the configuration of a liquid jet unit 1 according to the ninth embodiment of the present invention. The difference from the second embodiment is that a damper 6 is placed near the inflow port 2 instead of the pressure sensor S. The other configurations are the same as those of the second embodiment. Therefore, hereinbelow, only differences from the second embodiment will be described, and the descriptions of the same points will be omitted. The same components or components having the same function are denoted by the same signs as those in the second embodiment.

As illustrated in FIG. 9, the damper 6 which reduces the pressure fluctuation of liquid in the circulation path J1 is placed in the circulation path J1 at the position near the inflow port 2. The pressure sensor S is disposed in the damper 6. The liquid jet unit 1 may move when ejecting liquid droplets on a recording medium to perform recording. In liquid that exists inside the circulation path J and the supply path K, pressure fluctuation occurs due to the inertia thereof in association with the movement of the liquid jet unit 1. If the pressure fluctuation is transmitted to liquid inside the nozzle N when ejecting liquid droplets from the nozzle N, the ejecting speed and shapes of liquid droplets to be ejected change, which causes deterioration of the recording quality. Therefore, the damper 6 is placed in the circulation path J1 at the position near the inflow port 2 to reduce the pressure fluctuation caused by the inertia, thereby improving the recording quality. Further, the liquid pump P may generate pulsation accompanied by the pressure fluctuation. Furthermore, when the liquid pump P is driven to be turned on and off on the basis of pressure information generated by the pressure sensor S, the pressure fluctuation may occur. By using the damper 6, it is also possible to reduce such pulsation and pressure fluctuation. Since the pressure sensor S is disposed in the damper 6, the liquid jet unit 1 can be configured to be compact.

The damper 6 can include, for example, a housing having a recessed portion formed thereon, a flexible film that blocks an opening of the recessed portion, and a pressure sensor that detects pressure on the basis of displacement of the flexible film. Liquid in the circulation path J1 is circulated through a liquid chamber that is surrounded by the recessed portion and the flexible film. When pressure fluctuation caused by the inertia occurs in liquid in the circulation path J1, the flexible film of the damper 6 is displaced by expansion and contraction thereof, thereby reducing the pressure fluctuation. Further, by electrically, magnetically, or optically detecting the displacement of the flexible film, it is possible to detect the pressure of liquid filling the liquid chamber.

Hereinabove, in each of the first to ninth embodiments, an example in which the pressure sensor S is placed in the circulation path J1 at the position outside the liquid jet head H as well as near the inflow port 2 has been described. However, the present invention is not limited thereto. The pressure sensor S may be placed in the interior flow path 4 of the liquid jet head H, or may also be placed in the circulation path J2 at a position outside the liquid jet head H as well as near the outflow port 3. That is, the pressure sensor S can be placed at any location where the pressure of liquid in the interior flow path 4 is reflected.

Further, although an example in which liquid is drawn into the supply path K from the liquid tank T has been described, the present invention is not limited to such a configuration. An additional pump that increases or reduces the pressure of liquid with a constant pressure may be interposed between the supply path K and the liquid tank T. The scope of the present invention includes a case where the liquid-feeding amount of the liquid pump P, which is placed in the circulation path J, is controlled on the basis of pressure information generated by the pressure sensor S, and liquid is drawn into the circulation path J from the supply path K according to the liquid-feeding amount of the liquid pump P.

<Second Aspect>

Figure 10:
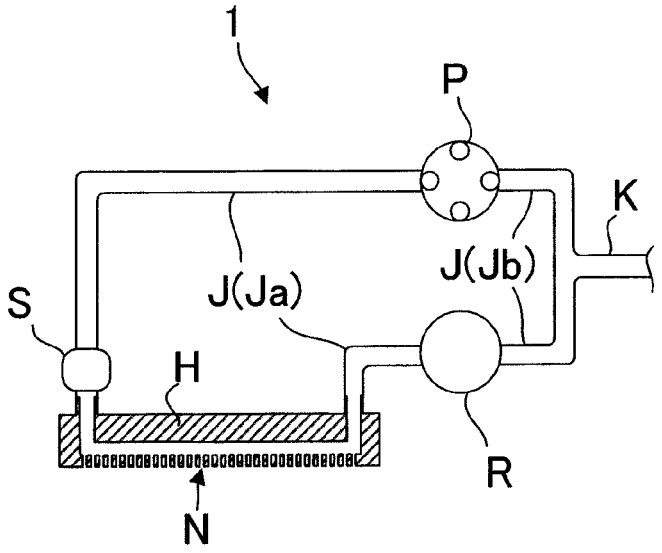
FIG. 10 is a conceptual diagram illustrating a second aspect of the liquid jet unit according to the present invention.

FIG. 10 is a conceptual diagram illustrating the second aspect of the liquid jet unit 1 according to the present invention. The liquid jet unit 1 is provided with a circulation path J through which liquid is circulated, a liquid jet head H which ejects liquid from a nozzle N communicating with the circulation path J, a liquid pump P which circulates liquid in the circulation path J, a supply path K which supplies liquid to the circulation path J, a flow restricting unit R which causes pressure loss in liquid being circulated through the circulation path J, and a pressure sensor S which generates pressure information according to the pressure of liquid in the circulation path J. The circulation path J includes a first flow path Ja and a second flow path Jb which communicate between the liquid pump P and the flow restricting unit R in parallel. The liquid jet head H and the pressure sensor S are placed in the first flow path Ja, and the supply path K is connected to the second flow path Jb.

When the pressure head of liquid in the supply path K is lower than the pressure head of liquid in the nozzle N, the liquid pump P is set to feed liquid to the first flow path Ja and take in liquid from the second flow path Jb. On the other hand, when the pressure head of liquid in the supply path K is higher than the pressure head of liquid in the nozzle N, the liquid pump P is set to feed liquid to the second flow path Jb and take in liquid from the first flow path Ja. That is, the liquid-feeding direction of the liquid pump P can be selected depending on the pressure head of the supply path K. For example, when attaching the liquid jet unit 1 to a liquid jet apparatus that supplies liquid from the liquid tank T to the supply path K, the liquid-feeding direction of the liquid pump P can be selected depending on whether the position of the liquid tank T is higher or lower than the position of the nozzle N in the gravity direction g.

In this manner, the circulation path J and the liquid tank T are connected to each other through the single supply path K. Further, the circulation of liquid through the circulation path J and the supply of liquid from the liquid tank T are performed by the single liquid pump P. Furthermore, the circulation direction of the liquid pump P can be selected depending on the position of the tank T. Therefore, it is possible to provide the liquid jet unit 1 with a simple structure and versatility.

A case where the liquid pump P takes in liquid from the second flow path Jb and feeds liquid to the first flow path Ja, and the pressure head of liquid in the supply path K is lower than the pressure head of liquid in the nozzle N corresponds to the second to fifth, eighth, and ninth embodiments described above. On the other hand, a case where the liquid pump P takes in liquid from the first flow path Ja and feeds liquid to the second flow path Jb, and the pressure head of liquid in the supply path K is higher than the pressure head of liquid in the nozzle N corresponds to the sixth and seventh embodiments described above. Therefore, detailed descriptions thereof will be omitted.

(Tenth Embodiment)

Figure 11:
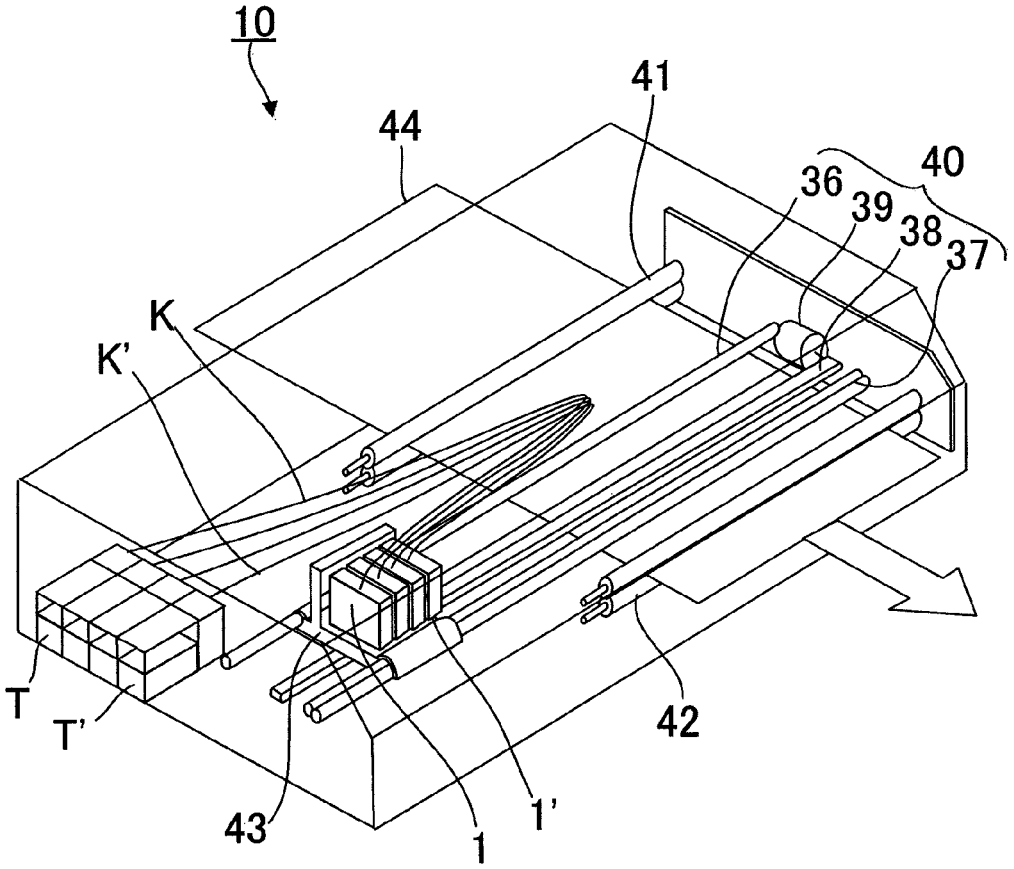
FIG. 11 is a schematic perspective view of a liquid jet apparatus according to a tenth embodiment of the present invention.
Figure 12:
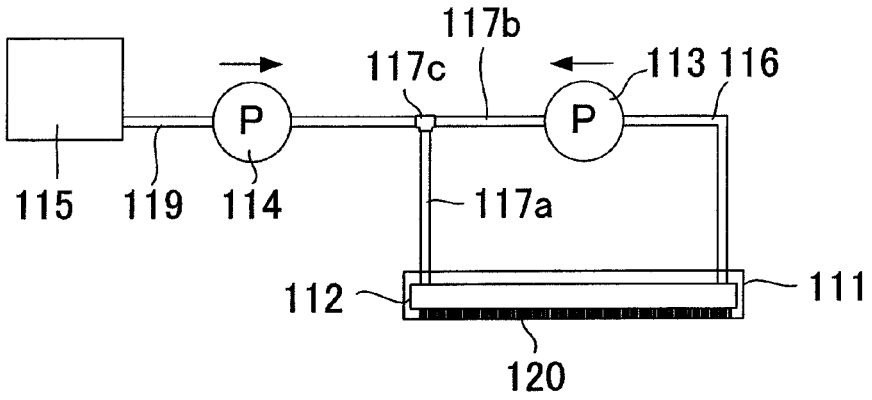
Fig.12 Prior art
FIG. 12 is a diagram of an ink flow path of a conventionally known ink jet recording apparatus.
Figure 13:
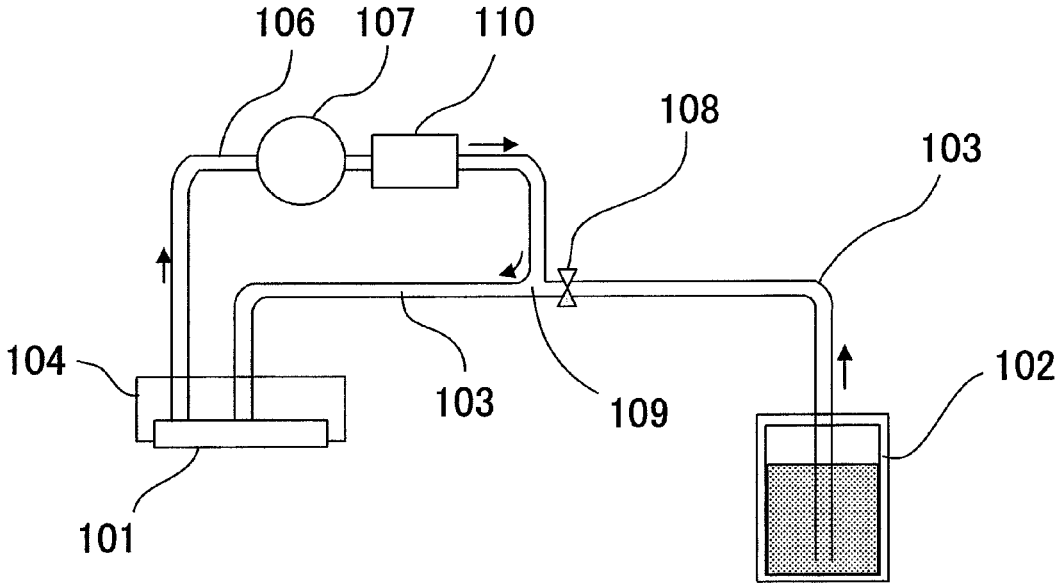
Fig.13 Prior art
FIG. 13 is a schematic view of a conventionally known liquid jet head using an ink jet system.

FIG. 11 is a schematic perspective view of a liquid jet apparatus 10 according to the tenth embodiment of the present invention. The liquid jet apparatus 10 is provided with a movement mechanism 40 which reciprocates liquid jet units 1 and 1', supply paths K and K' which respectively supply liquid to the liquid jet units 1 and 1', and liquid tanks T and T' which respectively supply liquid to the supply paths K and K'. Each of the liquid jet units 1 and 1' is provided with a plurality of liquid jet heads H. Each of the liquid jet heads H ejects liquid droplets from a plurality of nozzles. As each of the liquid jet units 1 and 1', any one of the liquid jet units of the first to ninth embodiments described above is used.

The liquid jet apparatus 10 is provided with a pair of conveyance units 41 and 42 which conveys a recording medium 44 such as paper in a main scanning direction, the liquid jet units 1 and 1' each of which ejects liquid onto the recording medium 44, a carriage unit 43 on which the liquid jet units 1 and 1' are loaded, the liquid tanks T and T', and the movement mechanism 40 which moves the liquid jet units 1 and 1' in a sub-scanning direction that is perpendicular to the main scanning direction. A control unit (not illustrated) controls the liquid jet units 1 and 1', the movement mechanism 40, and the conveyance units 41 and 42 to drive.

Each of the pair of conveyance units 41 and 42 extends in the sub-scanning direction, and includes a grid roller and a pinch roller which rotate with the roller surfaces thereof making contact with each other. The grid roller and the pinch roller are rotated around the respective axes by a motor (not illustrated) to thereby convey the recording medium 44, which is sandwiched between the rollers, in the main scanning direction. The movement mechanism 40 is provided with a pair of guide rails 36 and 37 each of which extends in the sub-scanning direction, the carriage unit 43 which can slide along the pair of guide rails 36 and 37, an endless belt 38 to which the carriage unit 43 is coupled to move the carriage unit 43 in the sub-scanning direction, and a motor 39 which revolves the endless belt 38 via a pulley (not illustrated).

The carriage unit 43 loads the plurality of liquid jet units 1 and 1' thereon. The liquid jet units 1 and 1' eject, for example, respective four colors of liquid droplets including yellow, magenta, cyan, and black. Each of the liquid tanks T and T' stores liquid of corresponding color, and supplies the stored liquid to each of the liquid jet units 1 and 1' through each of the supply paths K and K'. Each of the liquid jet units 1 and 1' ejects liquid droplets of corresponding color in response to a driving signal. Any patterns can be recorded on the recording medium 44 by controlling the timing of ejecting liquid from the liquid jet units 1 and 1', the rotation of the motor 39 for driving the carriage unit 43, and the conveyance speed of the recording medium 44.

In the liquid jet apparatus 10 of the present embodiment, the movement mechanism 40 moves the carriage unit 43 and the recording medium 44 to perform recording. Alternatively, however, the liquid jet apparatus may have a configuration in which a carriage unit is fixed, and a movement mechanism two-dimensionally moves a recording medium to perform recording. That is, the movement mechanism may have any configuration as long as it can relatively move a liquid jet head and a recording medium. Further, in the present embodiment, the description has been made with regard to the case where the liquid jet unit 1 is loaded on the carriage unit 43. Alternatively, however, the supply path K and the liquid pump P may be fixed to the liquid jet apparatus 10, and connected, via the circulation paths J1 and J2, to the carriage unit 43 as a movable unit on which the liquid jet head H is loaded.

What is claimed is:

1. A liquid jet unit comprising:

a circulation path through which liquid is circulated;

a liquid jet head including an inflow port and an outflow port, a flow path disposed between the inflow port and the outflow port and forming a part of the circulation path, and a nozzle communicating with the flow path and being configured to eject liquid from the liquid jet head;

a liquid pump arranged in the circulation path and configured to circulate liquid in the circulation path;

a tank for storing liquid, the tank being located below the nozzle in a gravity direction and being connected via a supply path to the liquid pump, the supply path having no pump and being connected at one end to the tank and connected at another end to the circulation path at a connection point between the outflow port and the liquid pump to supply liquid to the circulation path, and the circulation path having no pump in the part of the circulation path between the outflow port and the connection point; and a pressure sensor configured to detect the pressure of liquid in the circulation path and generate pressure information, the liquid pump being configured to change an amount of liquid to be fed on the basis of the pressure information generated to maintain liquid in the nozzle at a predetermined pressure and draw liquid into the circulation path from the supply path.

2. The liquid jet unit according to claim 1, wherein a flow path resistance in the circulation path at a part between the vicinity of the outflow port and the connection point to which the supply path is connected is larger than a flow path resistance in the circulation path at a part between the liquid pump and the inflow port.

3. The liquid jet unit according to claim 1, further comprising a flow restricting unit configured to cause pressure loss in the circulated liquid, the the flow restricting unit being disposed in the flow path between the inflow port and the outflow port.

4. The liquid jet unit according to claim 1, further comprising a flow restricting unit configured to cause pressure loss in the circulated liquid, the flow restricting unit being disposed in the circulation path at a position between the liquid pump and the outflow port, and the supply path being connected to the circulation path at a position between the flow restricting unit and the liquid pump.

5. The liquid jet unit according to claim 4, further comprising another liquid jet head configured to take in liquid from the circulation path at a part between the inflow port and the liquid pump and to discharge liquid into the circulation path at a part between the outflow port and the flow restricting unit.

6. The liquid jet unit according to claim 1, wherein the supply path is connected to the flow path between the inflow port and the outflow port at a position near the outflow port.

7. The liquid jet unit according to claim 1, further comprising a flow restricting unit configured to cause pressure loss in the circulated liquid, the flow restricting unit being disposed in the flow path between the inflow port and the outflow port at a position near the outflow port.

8. The liquid jet unit according to claim 7, wherein the supply path is connected to the flow path at a position between the flow restricting unit and the outflow port.

9. The liquid jet unit according to claim 1, wherein a pressure head of liquid supplied from the supply path is lower than a pressure head of liquid in the nozzle.

10. The liquid jet unit according to claim 1, further comprising a flow restricting unit configured to cause pressure loss in the circulated liquid, the flow restricting unit being disposed in the circulation path at a position between the liquid pump and the inflow port, and the supply path being connected to the circulation path at a position between the liquid pump and the flow restricting unit.

11. The liquid jet unit according to claim 10, further comprising another liquid jet head configured to take in liquid from the circulation path at a part between the inflow port and the flow restricting unit and to discharge liquid into the circulation path at a part between the outflow port and the liquid pump.

12. The liquid jet unit according to claim 1, wherein a pressure head of liquid supplied from the supply path is higher than a pressure head of liquid in the nozzle.

13. The liquid jet unit according to claim 1, wherein the pressure sensor is disposed in the circulation path at a position near the inflow port or the outflow port.

14. The liquid jet unit according to claim 1, further comprising a damper configured to reduce pressure fluctuation of liquid, the pressure sensor being disposed in the damper.

15. The liquid jet unit according to claim 1, further comprising a valve for varying an amount of pressure loss in the circulated liquid.

16. The liquid jet unit according to claim 1, wherein the supply path and the circulation path are connected to each other via a three-way valve, and the three-way valve is switchable between a three-way communicating state and a two-way communicating state in which one way of the circulation path communicates with the supply path and the other way of the circulation path is closed.

17. A liquid jet apparatus comprising:

the liquid jet unit according to claim 1;

a liquid tank configured to supply liquid to the supply path of the liquid jet unit; and a movement mechanism configured to relatively move the liquid jet unit and a recording medium on which recording is carried out by liquid ejected from the liquid jet unit.

18. The liquid jet unit according to claim 1; wherein the tank is separate from and does not constitute part of the circulation path.

19. A liquid jet unit comprising:

a circulation path through which liquid is circulated;

a liquid jet head configured to eject liquid from a nozzle communicating with the circulation path;

a liquid pump configured to circulate liquid in the circulation path;

a supply path configured to supply liquid to the circulation path;

a flow restricting unit configured to cause pressure loss in liquid being circulated through the circulation path; and a pressure sensor configured to generate pressure information according to the pressure of liquid in the circulation path;

wherein the circulation path includes a first flow path and a second flow path communicating between the liquid pump and the flow restricting unit in parallel, the liquid jet head and the pressure sensor being disposed in the first flow path, and the supply path being connected to the second flow path.

20. The liquid jet unit according to claim 19, wherein the liquid pump takes in liquid from the second flow path and feeds liquid to the first flow path, and a pressure head of liquid in the supply path is lower than a pressure head of liquid in the nozzle.

21. The liquid jet unit according to claim 19, wherein the liquid pump takes in liquid from the first flow path and feeds liquid to the second flow path, and a pressure head of liquid in the supply path is higher than a pressure head of liquid in the nozzle.

22. A liquid jet apparatus comprising:

the liquid jet unit according to claim 19;

a liquid tank configured to supply liquid to the supply path of the liquid jet unit; and a movement mechanism configured to relatively move the liquid jet unit and a recording medium on which recording is carried out by liquid ejected from the liquid jet unit.

23. A liquid jet unit comprising:

a circulation path through which liquid is circulated;

a liquid jet head including an inflow port and an outflow port, a flow path disposed between the inflow port and the outflow port and forming a part of the circulation path, and a nozzle communicating with the flow path and being configured to eject liquid from the liquid jet head;

a liquid pump arranged in the circulation path and configured to circulate liquid in the circulation path;

a tank for storing liquid, the tank being separate from and not constituting part of the circulation path;

a supply path connected at one end to the tank and connected at another end to the circulation path at a connection point between the liquid pump and the inflow port to supply liquid to the circulation path; and a pressure sensor configured to detect the pressure of liquid in the circulation path and generate pressure information, the liquid pump being configured to change an amount of liquid to be fed on the basis of the pressure information generated to maintain liquid in the nozzle at a predetermined pressure and draw liquid into the circulation path from the supply path.

24. The liquid jet unit according to claim 23, wherein a flow path resistance in the circulation path at a part between the vicinity of the inflow port and the connection point to which the supply path is connected is larger than a flow path resistance in the circulation path at a part between the outflow port and the liquid pump.

25. The liquid jet unit according to claim 23; wherein the tank is disposed a prescribed height above the nozzle.

* * * * *